United States Patent [19]

Karino

[11] Patent Number: 4,601,976

[45] Date of Patent: Jul. 22, 1986

[54] MULTILAYER COLOR PHOTOGRAPHIC LIGHT-SENSITIVE MATERIAL

[75] Inventor: Yukio Karino, Kanagawa, Japan

[73] Assignee: Fuji Photo Film Co., Ltd., Kanagawa, Japan

[21] Appl. No.: 765,986

[22] Filed: Aug. 15, 1985

[30] Foreign Application Priority Data

Aug. 16, 1984 [JP] Japan ..... 59-170591

[51] Int. Cl.[4] ..... G03C 1/40; G03C 5/54; G03C 1/80; G03C 1/96

[52] U.S. Cl. ..... 430/496; 430/207; 430/212; 430/215; 430/217; 430/220; 430/409; 430/510; 430/523; 430/539; 430/598

[58] Field of Search ..... 430/207, 212, 215, 217, 430/220, 409, 598, 523, 536, 537, 531, 539, 510, 496

[56] References Cited

U.S. PATENT DOCUMENTS 4,341,858 7/1982 Chaffee et al. ..... 430/217

4,416,969 11/1983 Magee et al. ..... 430/217

*Primary Examiner*—Richard L. Schilling

*Attorney, Agent, or Firm*—Sughrue, Mion, Zinn, Macpeak & Seas

[57] ABSTRACT

A multilayer color photographic light-sensitive material containing no image-receiving layer is described, comprising a support, an internal latent image type direct reversal silver halide emulsion layer combined with a dye-providing substance, and a void layer between the support and the layer containing the dye-providing substance closest to the support.

20 Claims, No Drawings

MULTILAYER COLOR PHOTOGRAPHIC LIGHT-SENSITIVE MATERIAL

FIELD OF THE INVENTION

This invention relates to a photographic light-sensitive materials, particularly to a multilayer color photographic light-sensitive material comprising a direct reversla silver halide, and moe particularly to a color diffusion transfer photographic light-sensitive material.

BACKGROUND OF THE INVENTION

Direct reversal emulsions, photographic light-sensitive materials using direct reversal emulsions, and clor diffusion transfer process photographic light-sensitive materials using combinations of nucleating agents and internal latent image type direct reversal emulsions are well known, as described in James, T. H., *The Theory of the Photographic Process,* Macmillan Publishing Co. (1977). Furthermore, it is well known that a color light-sensitive material having a multiplicity of silver halide emulsion layers laminated together provides excellent color reproduction, and provides a color image with excellent picture quality.

However, a multilayer color photographic light-sensitive material comprising a combination of a nucleating agent and an internal latent image type direct reversal emulsion is also disadvantageous, in that a silver halide emulsion layer close to the support does not fully undergo development, in that the material is highly susceptible to the influence of the treatment conditions, and in that the material's shelf life is poor. This phenomenon is remarkable especially in a color diffusion transfer process photographic light-sensitive material comprising at least one layer of internal latent image type direct reversal emulsion combined with a dye image donor provided on one support and an image receiving layer provided on another support. A novel nucleating agent composition is described as a means of promoting formation of the nucleus of an internal latent image type direct reversal emulsion in U.S. Pat. No. 4,416,969. However, this nucleating agent composition is not sufficient to overcome the above deficiency.

SUMMARY OF THE INVENTION

Therefore one object of the present invention is to provide a photographic light-sensitive material having an excellent image.

Another object of the present invention is to provide a color photographic light-sensitive material which is not susceptible to the influence of the treatment conditions.

A further object of the present invention is to provide a color photographic light-sensitive material having a prolonged shelf life.

These and other objects of the present invention will become more apparent from the following description and examples.

As a result of extensive studies for achieving these objects, the inventors have found that the above objects can be achieved by a multilayer color photographic light-sensitive material containing no image-receiving layer, which comprises a support, an internal latent image type direct reversal silver halide emulsion layer combined with a dye-providing substance, and a void layer between the support and the layer containing the dye-providing substance closest to the support.

The effect of the present invention is remarkable especially in a color diffusion transfer photographic element comprising a light-sensitive sheet in which a multi-layer color photographic light-sensitive material comprises at least one layer of internal latent image type direct reversal emulsion combined with a dye-providing substance supported on one support, an image receiving sheet comprising at least one image receiving layer supported on another support, and a treatment liquid pod containing an alkaline viscous treatment composition.

In particular, the present invention is effective in that when an alkaline treatment composition is spread between the light-sensitive sheet and the image receiving sheet by a roller or other means so that the color diffusion transfer photographic element undergoes treatment, the unevenness in the image corresponding to the distribution of the thickness of the treatment composition is remarkably less than in the prior art; in that the fluctuation of the photographic properties due to the fluctuation of the thickness of the treatment composition caused by the change in the roller pressure, the spreading speed, or the like is smaller than in the prior art; in that the fluctuation of the maximum concentration due to the fluctuation of the temperature at which the treatment composition is spread and treatment conducted is improved; and in that the shelf life of color diffusion transfer photographic elements is remarkably improved.

DETAILED DESCRIPTION OF THE INVENTION

The void layer of the present invention is a layer having some amount of voids, resulting from solid particles dispersed therein, and is preferably formed by applying on a support a mixture of solid particles and a small amount of a binder. This void layer is deemed to be filled with air unless otherwise treated. As solid particles to be used for the void layer there may be employed white pigment such as white lead, zinc oxide, titanium dioxide, barium sulfate, lithopone, and zirconium oxide, color pigment such as aureolin, cobalt green, cobalt blue, cerulean blue, cobalt violet, ultramarine, cadmium red, lead chromate, indanthrene blue, Phthalocyanine blue, silica, carbon black, finely divided glass particles, diatomaceous earth, and particulate polymer. Titanium dioxide is most preferable among them, in that it is easily forms a void layer, that it has little effect on the light-sensitive layer, and that it provides a great effect. The suitable applied amount of solid particles is generally from about 1 $g/m^2$ to 30 $g/m^2$, and preferably from 1 $g/m^2$ to 10 $g/m^2$.

Titanium dioxide for use in the present invention may be of either rutile type or anatase type, and may be prepared by either the sulfate process or the chloride process. Furthermore, the titanium dioxide to be used may be surface-treated. Commercially available titanium dioxide has normally been previously surface-treated with aluminum dioxide, zinc oxide, silicone dioxide, etc. While the treated amount of titanium dioxide varies with the desired object, a suitable value is generally from about 1 to 20%, and preferably from about 2 to 10%. Titanium dioxide which has been surface-treated with an organic material such as triethanolamine may also be used.

As binder to be mixed with the solid particles, a hydrophilic binder is preferably used. Examples of such hydrophilic binders which may be used include protein such as gelatin, gelatin derivatives, a graft polymer of gelatin with a high molecular weight compound, albumin, and casein, cellulose derivative such as hydroxyethyl cellulose, carboxymethyl cellulose, and cellulose ester sulfate, and sugar derivatives such as sodium alginate and starch derivative. In addition to these naturally derived compounds, such hydrophilic binders include synthetic hydrophilic high molecular weight compounds such as polymers. These polymers include polyvinyl alcohol, partially acetalized polyvinyl alcohol, poly-N-vinylpyrrolidone, polyacrylic acid, polymethacrylic acid, polyacrylamide, polyvinylimidazole, and polyvinylpyrazole.

As the gelatin, lime-treated gelatin, acid-treated gelatin, enzyme-treated gelatin as described in *Bull. Soc. Sci. Phot. Japan,* No. 16, p. 30 (1966), and hydrolyzate or enzyme-decomposition products of gelatin may be used. Examples of gelatin derivatives that may be used include the product of the reaction of a gelatin with acid halide, acid anhydride, isocyanate, bromoacetic acid, alkanesultones, vinylsulfonamide, maleinimide compound, polyalkylene oxide, or epoxy compound. Examples of such gelatin derivatives are described in U.S. Pat. Nos. 2,614,928, 3,132,945, 3,186,846, 3,512,553, British Pat. Nos. 861,414, 1,033,189, 1,005,784, and Japanese Patent Publication No. 26845/67.

Examples of gelatin graft polymers that may be used include products of graft reactions of a gelatin with acrylic acid, methacrylic acid, and ester or amide derivatives thereof, or with a vinyl monomer such as acrylonitrile and styrene, singly or in the form of copolymer. In particular, a polymer which has some compatibility with gelatin is preferably used, such as graft polymer made of a polymer and acrylic acid, methacrylic acid, acrylamide, methacrylamide, hydroxyalkyl methacrylate, or the like. Examples of such graft polymers are described in U.S. Pat. Nos. 2,763,625, 2,831,767, and 2,956,884.

Examples of typical synthetic hydrophilic high molecular weight compounds are described in West German Patent Application (OLS) No. 2,312,708, U.S. Pat. Nos. 3,620,751, 3,879,205, and Japanese Patent Publication No. 7561/68.

Gelatin is especially suitable as hydrophilic binder because it is easy to mix with solid particles, easy to apply to a support, and can strongly adhere to a light-sensitive layer.

The presence of the voids in accordance with the present invention is believed to serve to put the emulsion layer closest to the support in a more oxidizing environment, provided by oxygen contained therein during storage or treatment. In addition, the presence of the voids is believed to serve to absorb the alkaline treatment composition and store it in the voids, so that nucleus formation in the sublayer close to the support is promoted. Furthermore, the reason why titanium dioxide is suitable as solid particle is believed to be that it supplies oxygen. However, the mechanism is not completely clear.

While the void volume depends on the type of silver halide emulsion, the dye-providing substance, the alkaline treatment composition, the solid particle used for forming void layer, and the binder used, and the desired effect, a suitable value is generally from about 0.01 $cm^3/m^2$ to 5 $cm^3/m^2$, and preferably from about 0.1 $cm^3/m^2$ to 2 $cm^3/m^2$. If excess void volume is present, bubbles may form upon treatment, which results in a small undyed (whitened) circle.

The thickness of the void layer depends on the material to be used and the desired object. Suitable thickness is generally from about 1 μm to about 20 μm, and preferably from about 1 μm to 10 μm.

If spherical particles are packed into the void layer, the proportion of its volume in the entire volume of the layer is theoretically about 74%. Therefore, if the volume proportion of the solid particles to the binder is smaller than 74/26, such that the latter is used in a greater amount, one might think that there are no voids present. However, most solid particles to be used more rarely spherical, except particulate polymeric latex. Further, these solid particles generally are in the form of aggregates. Accordingly, these solid particles generally have pores which are not filled with the binder. Therefore, even if the above volume proportion is used, generally voids are still present.

The volume of the voids can be calculated from the difference between the measured thickness of the void layer and the thickness of the void layer calculated from the sum of the volume of the solid particles and the binder used.

While the average particle diameter of the solid particles is not limited unless the solid particles cannot easily be mixed with the binder, with the result that when applied, it provides poor surface conditions which impairs the desired performance, a suitable average value is generally from about 0.05 μm to 20 μm, and preferably from about 0.1 μm to 10 μm. When the solid particles are not spherical, the average particle diameter of non-spherical particles is determined in terms of the diameter of spherical particles having the same volume as that the non-spherical particles. The solid particles may optionally be, and finely dispersed by a dispersing apparatus.

A suitable distance between the silver halide emulsion layer closest to the support and the void layer is preferably 10 μm or less, and more preferably 5 μm or less. In a most preferred embodiment, a layer containing a dye-providing substance, preferably about 1.5 μm-thick, combined with the silver halide emulsion layer closest to the support is interposed between the void layer and the silver halide emulsion layer.

The void layer of the present invention may also reflect light upon exposure, to improve the efficiency of utilization of the light so that the sensitivity of the silver halide emulsion layer is improved. Rather, however, the void layer of the present invention preferably has no optical effect.

Therefore, in a preferred embodiment of the present invention, the void layer and/or a layer disposed between the void layer and the silver halide emulsion layer closest thereto, for example, a layer containing a dye-providing substance, is colored, so that the photographic sensitivity of the silver halide emulsion layer is not substantially changed. To this end, a coloring substance (light absorbing substance) such as carbon black is preferably added to the void layer and/or the dye-providing substance. For this purpose, any substance other than carbon black may be used unless it has photographically adverse effects.

While the support of the present invention for the light-sensitive element and the image receiving element may be either transparent or opaque, there is preferably used a material which is not subject to significant change in size during treatment. Examples of such supports include cellulose acetate film, polystyrene film, polyethylene terephthalate film, polycarbonate film, baryta paper, and paper laminated with a polymer impermeable to water, such as polyethylene.

To obtain a white background, a whitening agent such as titanium oxide and barium sulfate may be added to or applied onto the support.

Furthermore, to enable the spreading in light, a polyethylene laminate containing a light screen such as carbon black or a water-soluble polymer (such as gelatin and polyvinyl alcohol) having a light screen such as carbon black dispersed therein is applied to the support so that the support can shade the light. While the amount added to provide the light screen may be determined according to the sensitivity of the particular light-sensitive material to be protected, the suitable value is preferably from about 5 to 10 in terms of optical density.

A neutralizing mechanism is preferably provided in the image receiving element (disposed between the support and the image receiving layer) or the light-sensitive element (disposed between the support and the silver halide emulsion layer) in a diffusion transfer photographic material according to the present invention. Such a neutralizing mechanism is normally composed of a neutralizing layer and, optionally, a neutralization timing layer combined therewith.

As the neutralizing layer, any film forming acidic polymer may be used. Examples of such acidic polymers include monobutyl ester of copolymer of maleic anhydride and ethylene, monobutyl ester of copolymer of maleic anhydride and methyl vinyl ether, monoethyl ester of copolymer of maleic anhydride and ethylene, monopropyl ester of the foregoing copolymer, monopentyl ester of the foregoing copolymer, monohexyl ester of the foregoing copolymer, monoethyl ester of copolymer of maleic anhydride and methyl vinyl ether, monopropyl ester of the foregoing copolymer, monobenzyl ester of the foregoing copolymer, monohexyl ester of the foregoing copolymer, copolymers prepared from polyacrylic acid, polymethacrylic acid, acrylic acid, and methacrylic acid in various proportions, and copolymers prepared from acrylic acid or methacrylic acid and other vinyl monomers such as acrylic esters, methacrylic esters, vinyl ethers, acrylamides, and methacryl amides in various proportions, preferably the content of acrylic acid or methacrylic acid is from 50 to 90 mol%. Examples of neutralizing layers are described in U.S. Pat. Nos. 3,362,819, 3,765,885, 3,819,371, and French Pat. No. 2,290,699. Most effective among these neutralizing layers are polyacrylic acid and acrylic acid-butyl acrylate copolymer.

As main ingredient of the neutralizing timing layer to be combined with the neutralizing layer, gelatin, polyvinyl alcohol, polyacrylamide, polyvinyl acetate which has been partially hydrolyzed, copolymer of $\beta$-hydroxyethyl methacrylate and ethyl acrylate, and acetyl cellulose may be used. In addition, materials described in U.S. Pat. Nos. 3,455,686, 3,421,893, 3,785,815, 3,847,615, 4,009,030, and Japanese Patent Application (OPI) No. 14415/77 (the term "OPI" as used herein means "an examined published patent application"). Furthermore, the above neutralization timing layer and a polymer layer which has a great temperature dependence of permeation of alkaline treatment solution as described in U.S. Pat. Nos. 4,056,394, 4,061,496, Japanese Patent Application (OPI) Nos. 72622/78 and 78130/79 can be used together.

Other examples of materials which can be used in the neutralization timing layer of the invention include products of polymerization of monomers which can undergo—elimination in an alkaline atmosphere, as described in U.S. Pat. Nos. 4,288,523, 4,201,587, and 4,229,516, Japanese Patent Application (OPI) Nos. 121438/80, 166212/81, 41490/80, 54341/80, 102852/81, 141644/82, 173834/82, 179841/82, and 19137/85, West German Patent Application (OLS) No. 2,910,271, European Patent Application No. EP 31957 Al, and *Research Disclosure,* RD No. 18452.

The image-receiving layer for use in the present invention is preferably a hydrophilic colloid layer containing a polymeric mordant.

As the polymeric mordant for use in the present invention, polymers containing secondary and tertiary amino groups, polymers having nitrogen-containing heterocyclic portions, and polymers containing quaternary cation groups thereof which preferably have a molecular weight of from 5,000 to 200,000 and more preferably from 10,000 to 50,000, may be used.

Examples of such polymeric mordants include vinylpyridine polymer and vinylpyridium cation polymer as described in U.S. Pat. Nos. 2,548,564, 2,484,430, 3,148,061, and 3,756,814; imidazole polymer as described in Japanese Patent Application (OPI) Nos. 48210/80 and 129346/80, U.S. Pat. Nos. 4,282,305, 4,273,853, 4,193,796, 4,228,257, and 4,229,515; gelatin and crosslinkable polymeric mordants as disclosed in U.S. Pat. Nos. 3,625,694, 3,859,096 and 4,128,538, and British Pat. No. 1,277,453; latex type mordant or aqueous sol type mordant as disclosed in U.S. Pat. Nos. 3,958,995, 2,721,852 and 2,798,063, Japanese Patent Application (OPI) Nos. 115228/79, 145529/79, 126027/79, and 232340/84, water-insoluble mordant as described in U.S. Pat. No. 3,898,088, reactive mordant which can be covalently bonded to dye as disclosed in U.S. Pat. No. 4,168,976; and mordant as disclosed in U.S. Pat. Nos. 3,709,690, 3,788,855, 3,642,482, 3,488,706, 3,557,066, 3,271,147, and 3,271,148, and Japanese Patent Application (OPI) Nos. 71332/75, 30328/78, 155528/72, 125/78, and 1024/78.

Besides the above mordants, mordants as described in U.S. Pat. Nos. 2,675,316 and 2,882,156 may also be used.

Preferable among these mordants is a mordant which substantially does not migrate from the mordant layer, such as mordant crosslinkable to a matrix such as gelatin, water-insoluble mordant, and latex dispersion (or aqueous sol) type mordant.

As non-diffusive dye-providing substances for use in the present invention there may be used any compound which releases a diffusive dye or its precursor imagewise as a result of development, such as non-diffusive coupler which releases a diffusive dye. One of preferred examples of such couplers is a dye-releasing redox compound. Such a dye-releasing redox compound may be either of negative type (negative working) or positive type, but is preferably of negative type. A negative type dye-releasing redox compound can be combined with a direct reversal emulsion to provide a positive image.

A dye-releasing redox compound which may be used in the present invention can be represented by the formula $$Y—D$$

wherein D stands for a dye or its precursor; and Y stands for a group which serves to release a diffusible dye or its precursor imagewise as a result of development, Y and D being optionally bonded to each other by a proper linking group.

Examples of Y are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, and Japanese Patent Application (OPI) Nos. 50736/78, 10434/76, 130122/79, 110827/78, 12642/81, 16131/81, 4043/82, 650/82, 20735/82, 69033/78, 130927/79, 164342/81, and 119345/82.

One of the most preferred examples of group Y in the negative type dye-releasing redox compound is an N-substituted sulfamoyl group (wherein the N-substituted group may be a group derived from an aromatic hydrocarbon ring or hetero ring). Examples of typical Y groups are set forth below, but the present invention is not to be construed as being limited thereto.

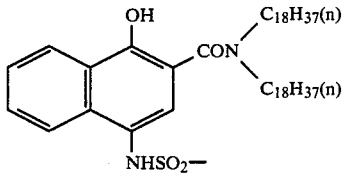

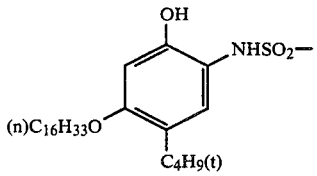

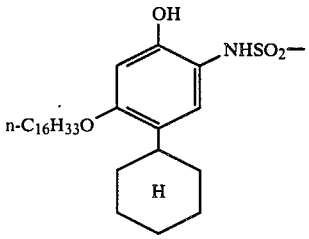

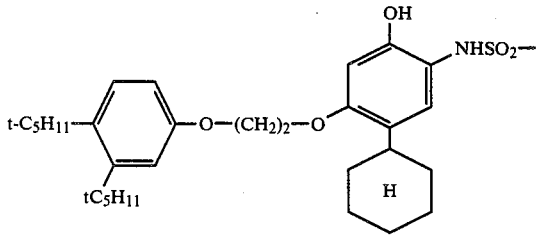

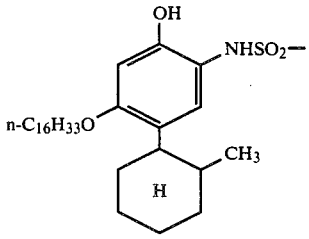

Examples of typical Y groups in positive dye-releasing redox compounds are set forth below, again without limiting the present invention.

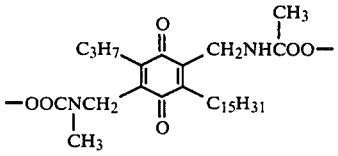

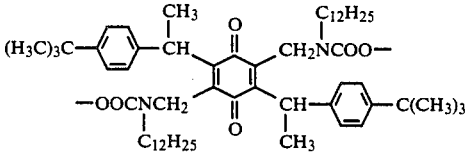

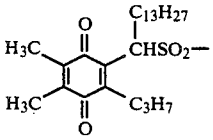

This type of a compound may preferably used in combination with a diffusion resistant electron donor compound (known as an ED compound) or a precursor thereof. Examples of such ED compounds are described in U.S. Pat. Nos. 4,263,393 and 4,278,750, and Japanese Patent Application (OPI) No. 138736/81.

On the other hand, examples of dye represented by D in the formula Y-D are described in the following literature:

Examples of yellow dyes are described in U.S. Pat. Nos. 3,597,200, 3,309,199, 4,013,633, 4,245,028, 4,156,609, 4,139,383, 4,195,992, 4,148,641, 4,148,643 and 4,336,322, Japanese Patent Application (OPI) Nos. 114930/76 and 71072/81, and *Research Disclosure,* RD No. 17630 (1978) and RD No. 16475 (1977).

Examples of magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, Japanese Patent Application (OPI) Nos. 106727/77, 106727/77, 236728/78, 36804/80, 73057/81, 71060/81, and 134/80.

Examples of cyan dyes are described in U.S. Pat. Nos. 3,482,972, 3,929,760, 4,013,635, 4,268,625, 4,171,220, 4,242,435, 4,142,891, 4,195,994, 4,147,544, and 4,148,642, British Pat. No. 1,551,138, Japanese Patent Application (OPI) Nos. 99431/79. 8827/77, 47823/78, 143323/78, 99431/79, and 71061/81, European Patent (EPC) Nos. 53,037 and 53,040, and *Research Disclosure,* RD No. 17630 (1978) and RD No. 16475 (1977).

Other specific examples of dye-providing compounds which can be used include are set forth below.

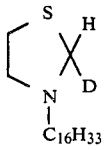

-continued

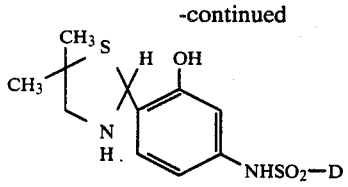

wherein D stands for a dye or a precursor thereof as defined above. Further details are described in U.S. Pat. Nos. 3,719,489 and 4,098,783.

The suitable applied amount of the dye-providing compound for use in the present invention is generally from about $1\times10^{-4}$ to $1\times10^{-2}$ mol/m$^2$, and preferably is from $2\times10^{-4}$ to $2\times10^{-3}$ mol/m$^2$.

The internal latent image type direct reversal silver halide emulsion for use in the present invention is a hydrophilic colloidal dispersion of silver chloride, silver bromide, silver chlorobromide, silver iodobromide, silver chloroiodobromide, or a mixture thereof. The halide composition is determined according to the particular intended application of the light-sensitive material and the treatment conditions. The most preferred halide compositions are silver bromide, silver iodobromide, or silver chloroiodobromide having an iodide content of 10 mol% or less and a chloride content of 30 mol% or less.

The silver halide particles may be in the crystal form of spherical, regular particles such as cubic, octahedral, and 14-facet structure, or flat plate-like (tabular) particles having an aspect ratio of 5/1 or more as described in Research Disclosure (No. 22534, Jan. 1983) and Japanese Patent Application (OPI) No. 108528/83.

The internal latent image type silver halide emulsion of the present invention may be an emulsion having crystal particles doped with an element of a different species such as copper, cadmium, lead and zinc, or an emulsion having an improved photographic property such as re-reversibility provided by such doping treatment, as described in U.S. Pat. No. 4,395,478.

The internal latent image type silver halide emulsion can be defined as one which shows a greater maximum density when developed with an "internal" developer than when developed with a "surface" developer.

The internal latent image type silver halide emulsion suitable for use in the present invention has an at least 5 times, or preferably more than 10 times, greater maximum density measured by an ordinary photographic density measurement process after being developed in a developer A (internal developer) having the composition described below at a temperature of 20° C. for 3 minutes following exposure to light for a certain period of time of from 0.01 to 1 second on a transparent support than measured after being developed in a developer B (surface developer) having the composition described below at a temperature of 20° C. for 4 minutes following the same exposure treatment.

DEVELOPER A

Hydroquinone: 15 g
Monomethyl-p-aminophenol sesquisulfate: 15 g
Sodium sulfite: 50 g
Potassium bromide: 10 g
Sodium hydroxide: 25 g
Sodium thiosulfate: 20 g
Water: Sufficient amount to make 1 liter

DEVELOPER B p-oxyphenylglycine: 10 g
Sodium carbonate: 100 g
Water: Sufficient amount to make 1 liter The interal latent image type silver halide emulsion which can be applied to the present invention may be a conversion emulsion obtained by a catastrophic precipitation process which comprises converting a highly soluble particulate silver salt such as silver chloride into a low-solubility silver salt such as silver (iodo)bromide as described in U.S. Pat. No. 2,592,250, a core/shell emulsion having core particles coated with a silver halide shell obtained by the process which comprises mixing chemically-sensitized oversize core emulsion particles with finely divided emulsion particles, and then physically aging the mixture as described in U.S. Pat. No. 3,206,313, a core/shell emulsion having core particles coated with a silver halide shell obtained by the process which comprises simultaneously adding a soluble silver salt solution and a soluble halide solution to a chemically-sensitized monodisperse core emulsion while maintaning the silver ion concentration constant as described in British Pat. No. 1,027,146 and U.S. Pat. No. 3,761,276; a halogen-localized emulsion whose particles have two ore more laminations, first and second phases being different from each other in halide composition, as described in U.S. Pat. No. 3,935,014; an emulsion having a metal of a different species contained therein obtained by a process which comprises allowing particulate silver halide to be produced in an acidic medium containing trivalent metal ions, as described in U.S. Pat. No. 3,447,927; or an internal latent image type emulsion prepared by a process as described in *Photographic Emulsions,* by E. T. Wall, pp. 35–36 and 52–53, American Photographic Publishing, New York (1929), U.S. Pat. Nos. 2,497,875, 2,563,785, and 3,511,662, and West German Patent Application (OLS) No. 2,728,108. The most preferable among these internal latent image type emulsions is a core/shell type emulsion.

As typical nucleating agents for use in the formation of direct positive images with the above internal latent image type emulsion, hydrazines as described in U.S. Pat. Nos. 2,563,785 and 2,588,982, hydrazides and hydroazones as described in U.S. Pat. No. 3,227,552, heterocyclic quaternary chlorides as described in British Pat. No. 1,283,835, Japanese Patent Application (OPI) No. 69613/77, U.S. Pat. Nos. 3,615,615, 3,719,494, 3,734,738, 4,094,683, and 4,115,122, sensitizing dyes having nucleating substituting groups in their molecules as described in U.S. Pat. No. 3,718,470, thiourea-bonded acyl hydrazine compounds as described in U.S. Pat. Nos. 4,030,925, 4,031,127, 4,245,037, 4,255,511, 4,266,013, 4,276,364, and British Pat. No. 2,012,443, and acyl hydrazine compounds having hetero ring groups such as thioamide ring, triazole and tetrazole bonded as adsorption group thereto, as described in U.S. Pat. Nos. 4,080,270 and 4,278,748, and British Pat. No. 2,011,391B may be used. However, nucleating agents useful in the present invention are not limited to the foregoing compounds.

The amount of the nucleating agent to be used is preferably such that when the internal latent image type emulsion is developed with a surface developer a sufficient maximum density is given. In effect, since the amount of the nucleating agent to be used greatly depends on the characteristics (size, condition of chemical sensitization, etc.) of the silver halide emulsion, the chemical structure of the nucleating agent, and the development conditions, the suitable content of the nucleating agent may have a wide variation. If the nucleating agent is added to the developer, the suitable content of the nucleating agent is generally from about 1 mg to 5 g, and preferably from 5 mg to 0.5 g, per liter of developer. If a nucleating agent is added to the emulsion layer, the effective amount of the nucleating agent to be used is generally from about 0.01 mg to 5 g, and preferably about 0.05 mg to 0.5 g, per mol of silver. If the nucleating agent is to be contained in the hydrophilic colloidal layer adjacent to the emulsion layer, the same weight proportion as above may be used for the amount of silver contained in the area of the emulsion layer corresponding to the colloidal layer.

In the present invention, the photographic emulsion may be subjected to spectral sensitization with respect to relatively long wavelength light such as blue light, green light, red light, and infrared light, by using a spectral sensitizing dye. Examples of such sensitizing dyes include cyanine dyes, merocyanine dye, complex cyanine dye, complex merocyanine dye, holopolar cyanine dye, styryl dye, hemicyanine dye, oxonol dye, and hemioxonol dye.

In the present invention, any silver halide developer may be used provided that it can serve to conduct cross-oxidation of the dye-providing compound. Such a developer may be contained in either the alkaline treatment solution or an appropriate layer in the light-sensitive element. Examples of developers which can be used in the present invention include hydroquinones, aminophenols, phenylenediamines, and pyrazolidones, such as 1-phenyl-3-pyrazolidinone, dimezone, 1-p-tolyl-4,4-dihydroxymethyl-3-pyrazolidinone, 1-p-tolyl-4-methyl-4-hydroxymethyl-3-pyrazolidinone, 1-(4'-methoxyphenyl)-4-methyl-4-hydroxymethyl-3-pyrazolidinone, and 1-phenyl-4-methyl-4-hydroxymethyl-3-pyrazolidinone as described in U.S. Pat. No. 4,336,322.

The most preferable among the above compounds is a black-and-white developer (especially pyrazolidinones) capable of reducing the stain formation in the image receiving layer more than a color developer such as phenylenediamine.

The treatment solution contains a base such as sodium hydroxide, potassium hydroxide, sodium carbonate, and sodium phosphate and thus has an alkaline strength of pH 9, preferably pH 11.5 or more. The treatment solution also may contain an oxidation inhibitor such as sodium sulfite, ascorbicate, and piperidinohexose reduction, or a silver ion concentration regulator such as potassium bromide. Alternatively, it may contain a viscosity increasing compound such as hydroxyethyl cellulose and sodium carboxymethyl cellulose.

Furthermore, the alkaline treatment solution may contain a compound which promotes development or dye diffusion, such as benzyl alcohol.

Moreover, the alkaline treatment solution may contain a white pigment such as $TiO_2$ and $ZnO_2$ for forming the background (white reflective layer) of the transfer image, or may contain a black pigment (carbon black, etc.) or a compound which shows a black color under an alkaline condition and changes to colorless upon a reduction in pH so that the development can be achieved in the light.

The alkaline treatment solution is preferably contained in a container which is rupturable under pressure.

In the multilayer color light-sensitive material, the silver halide emulsion and the dye-providing compound are combined with each other so that a proper combination of the color sensitivity of the silver halide emulsion and the spectral absorption of the dye image can be selected according to the desired color reproduction. In the production of natural color by the subtractive process, a light-sensitive element comprising a combination of at least two compounds, i.e., an emulsion having a selective spectral sensitivity within a certain wavelength range and a dye-providing compound having a selective spectral absorption within the same wavelength range, is used. In particular, a combination of a blue light-sensitive silver halide emulsion and a yellow dye-providing compound, a combination of a green light-sensitive emulsion and a magenta dye-providing compound, and a combination of a red light-sensitive emulsion and a cyan dye-providing compound are useful for the light-sensitive material of the invention. Such a combination of emulsion and dye-providing compound may be formed by applying the two compounds in the light-sensitive element in such a manner that two layers are formed in a face-to-face structure or by mixing the two compounds so that the two compounds are present in each particle and then applying the mixture so that one layer is formed.

Alternatively, the silver halide emulsion may be added to a middle layer in the light-sensitive element as described in U.S. Pat. No. 4,323,635.

If the light-sensitive material of the present invention is a color diffusion transfer photographic film unit, its typical embodiments include a so-called integral type film unit whose light-sensitive element and image receiving element form one body throughout all the procedures, including exposure to light, development, and inspection of the image transferred, as described in U.S. Pat. No. 3,415,644, and a so-called peel type film unit whose image receiving element is laminated with a light-sensitive element after the latter is exposed to light, but is entirely or partly separated from the latter after development, as described in U.S. Pat. No. 2,983,606. It goes without saying that the film units of the present invention include various modifications of the above two types of embodiments.

In any embodiments, the film unit of the present invention is preferably arranged such that upon the withdrawal from the camera after the light-sensitive element is exposed to light it is passed between a pair of pressing members put in juxtaposition with each other so that a container interposed between the light-sensitive element and the image receiving element is broken to release the treatment solution which is then spreaded over the entire surface of the light-sensitive element, whereby the silver halide thus light-exposed is developed.

The present invention is further illustrated by the following examples:

EXAMPLE 1

An image receiving sheet having the following composition was prepared.

Image receiving sheet

Paper support:

A 150 μm thick paper having a 30-μm thick polyethylene layer laminated therewith on both surface thereof was used. The polyethylene at the image receiving layer side had 10% by weight of titanium oxide dispersed therein.

Back side:

(a) A light screen layer containing 4.0 g/m$^2$ of carbon black and 2.0 g/m$^2$ of gelatin.

(b) A white layer containing 8.0 g/m$^2$ of titanium oxide and 1.0 g/m$^2$ of gelatin.

(c) A protective layer containing 0.6 g/m$^2$ of gelatin.

The layers (a), (b), and (c) were applied to the support in the order listed.

Image-receiving layer side:

(1) A neutralizing layer containing 22 g/m$^2$ of an acrylic acid-butylacrylate (molar proportion 8/2) copolymer having an average molecular weight of 50,000.

(2) A neutralization timing layer containing 4.5 g/m$^2$ of a combination of a cellulose acetate having a degree of acetylation of 51.3% (the amount of acetic acid released upon hydrolysis is 0.513 g per 1 g of sample) and a styrene-maleic anhydride copolymer (molar proportion 1/1) having an average molecular weight of 10,000 in a weight proportion of the former to the latter of 95/5.

(3) A layer containing a 6/4 solids content (by weight) proportion blend of a polymeric latex obtained by emulsion polymerization of styrene, butyl acrylate, acrylic acid, and N-methylolacrylamide in a weight proportion of 49.7/42.3/4/4 and a polymeric latex obtained by emulsion polymerization of methyl methacrylate, acrylic acid, and N-methylolacrylamide in a weight proportion of 93/3/4.

(4) An image receiving layer having 3.0 g/m$^2$ of polymers of the following general formulae and 3.0 g/m$^2$ of gelatin applied on a support using as a coating assistant a compound of the formula

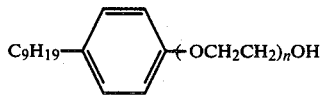

(n = 30)

Polymers

-continued

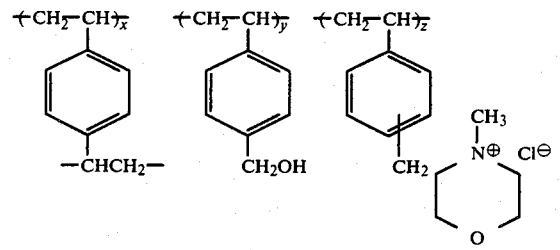

x:y:z = 5:5:90

(5) A protective layer having 0.6 g/m$^2$ of gelatin applied on a support.

Light-sensitive sheet

Light-sensitive sheets (1) to (8) were prepared by applying various layers on transparent polyethylene terephthalate supports as described below.

Back side:

(a) A light screen layer having 4.0 g/m$^2$ of carbon black and 2.0 g/m$^2$ of gelatin.

Emulsion layer side:

(1) Void layer as described in Table 1.

(2) A layer containing 0.44 g/m$^2$ of a cyan dye-releasing redox compound of the formula set forth below, 0.09 g/m$^2$ of tricyclohexyl phosphate, 0.008 g/m$^2$ of 2,5-di-t-pentadecylhydroquinone, and 0.8 g/m$^2$ of gelatin.

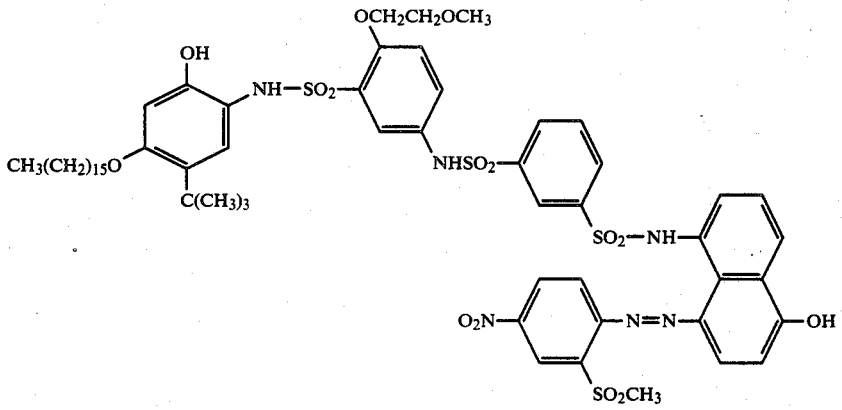

(3) A red light-sensitive emulsion layer containing a red light-sensitive internal latent image type direct reversal silver bromide emulsion (amount of silver: 1.03 g/m$^2$, amount of gelatin: 1.2 g/m$^2$), 0.04 mg/m$^2$ of a nucleating agent of the formula set forth below, and 0.13 g/m$^2$ of 2-sulfo-5-n-pentadecylhydroquinone sodium salt.

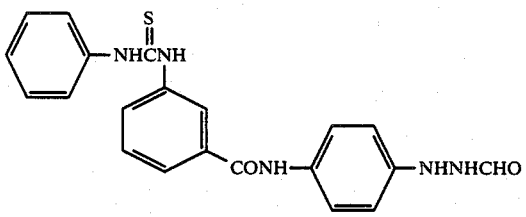

(4) A layer containing 0.43 g/m$^2$ of 2,5-di-t-pentadecylhydroquinone, 0.1 g/m$^2$ of trihexylphosphate, and 0.4 g/m$^2$ of gelatin.

(5) A layer containing 0.21 g/m$^2$ of a magenta cyan-releasing redox compound of the structural formula I set forth below, 0.11 g/m$^2$ of a magenta cyan-releasing redox compound of the structural formula II set forth below, 0.08 g/m$^2$ of tricyclohexylphosphate, 0.009 g/m$^2$ of 2,5-di-t-pentadecylhydroquinone, and 0.9 g/m$^2$ of gelatin.

Structural formula I

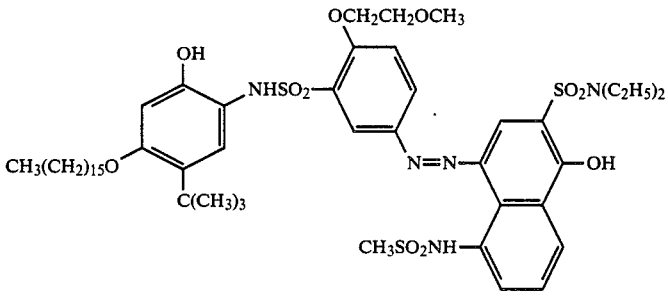

Structural formula II

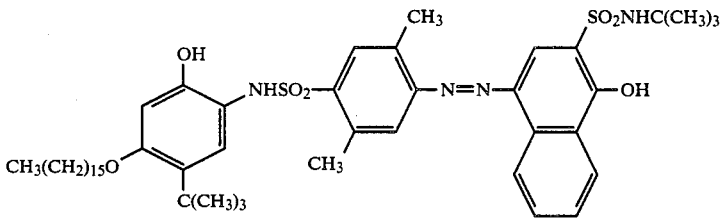

(6) A green light-sensitive emulsion layer containing a green light-sensitive internal latent image type direct reversal silver bromide emulsion (amount of silver: 0.82 g/m$^2$, amount of gelatin: 0.9 g/m$^2$), 0.03 mg/m$^2$ of the same nucleating agent as used in the layer (3), and 0.08 g/m$^2$ of 2-sulfo-5-n-pentadecylhydroquinone sodium salt.

(7) The same as layer (4).

(8) A layer containing 0.53 g/m$^2$ of a yellow cyan-releasing redox compound of the structural formula set forth below, 0.13 g/m$^2$ of tricyclohexylphosphate, 0.014 g/m$^2$ of 2,5-di-t-pentadecylhydroquinone, and 0.7 g/m$^2$ of gelatin.

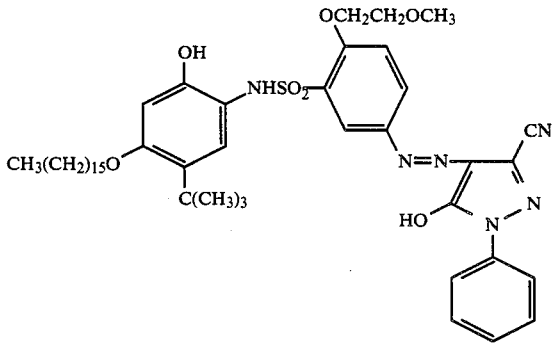

(9) A blue light-sensitive emulsion layer containing a blue light-sensitive internal latent image type direct reversal silver bromide emulsion (amount of silver: 1.09 g/m$^2$; amount of gelatin: 1.1 g/m$^2$), 0.04 mg/m$^2$ of the same nucleating agent as used in the layer (3), and 0.07 g/m$^2$ of 2-sulfo-5-n-pentadecylhydroquinone sodium salt.

(10) A layer containing 1.0 g/m$^2$ of gelatin.

TABLE 1

| Light-sensitive Sheet No. | Void Layer | | | |
|---|---|---|---|---|
| | Solid particles | | Binder | |
| 1 (control) | None | | None | |
| 2 | Titanium dioxide | 2.8 g/m$^2$ | Gelatin | 0.28 g/m$^2$ |
| 3 | " | 5.6 g/m$^2$ | " | 0.56 g/m$^2$ |
| 4 | " | 2.8 g/m$^2$ | " | 0.34 g/m$^2$ |
| 5 | " | 2.8 g/m$^2$ | " | 0.40 g/m$^2$ |
| 6 | " | 2.8 g/m$^2$ | " | 0.52 g/m$^2$ |
| 7 | Poly (methyl methacrylate) particles | 2.2 g/m$^2$ | " | 0.40 g/m$^2$ |
| 8 | Colloidal silica | 2.2 g/m$^2$ | " | 0.40 g/m$^2$ |

After being subjected to a forced aging test (Dry: 60° C., 30% RH, 3 days and Wet: 45° C., 75% RH, 3 days), the light-sensitive sheets in Table 1 were exposed to light transmitted through a color test chart and laminated with the above image receiving element. A treatment solution of the composition set forth below was then spread between the two sheets by means of a pressure roller in such a manner that a 65-μm thick layer was formed. The treatment was conducted at a temperature of 25° C. The light-sensitive sheet was peeled off the image receiving element 90 seconds after the treatment.

Treatment solution 1-p-tolyl-4-hydroxymethyl-4-methyl-3-pyrazolidone: 8.0 g
Methylhydroquinone: 0.1 g
5-Methylbenzotriazole: 5.0 g
Anhydrous sodium sulfite: 2.0 g
Hydroxyethyl cellulose: 40 g
Potassium hydroxide: 56 g
Benzyl alcohol: 2.0 g
Water (in an amount such that 1 kg of an aqueous solution of the above compounds is formed)

Table 2 shows the change in the maximum density.

TABLE 2

| Light-sensitive | blue | | | Green | | | Red | | |
|---|---|---|---|---|---|---|---|---|---|
| Sheet No. | Fresh | Dry | Wet | Fresh | Dry | Wet | Fresh | Dry | Wet |
| 1 | 2.08 | 2.09 | 2.12 | 2.50 | 2.46 | 2.40 | 2.50 | 2.36 | 0.82 |
| 2 | 2.04 | 2.06 | 2.12 | 2.53 | 2.50 | 2.48 | 2.49 | 2.42 | 1.63 |
| 3 | 1.98 | 2.04 | 2.10 | 2.50 | 2.50 | 2.44 | 2.45 | 2.45 | 1.64 |
| 4 | 2.01 | 2.07 | 2.15 | 2.52 | 2.50 | 2.48 | 2.45 | 2.28 | 1.58 |
| 5 | 2.00 | 2.10 | 2.13 | 2.50 | 2.50 | 2.44 | 2.58 | 2.25 | 1.60 |
| 6 | 1.99 | 2.10 | 2.11 | 2.51 | 2.51 | 2.46 | 2.30 | 2.38 | 1.43 |
| 7 | 2.00 | 2.08 | 2.10 | 2.49 | 2.48 | 2.46 | 2.46 | 2.28 | 1.21 |
| 8 | 1.98 | 2.07 | 2.11 | 2.50 | 2.46 | 2.42 | 2.47 | 2.30 | 1.18 |

As can be seen in Table 2, the light-sensitive sheets provided with a void layer showed an improved stability in the aging test, especially under high humidity conditions.

EXAMPLE 2

The light-sensitive sheets 1 and 2 as used in Example 1 were exposed to a light ray transmitted through a color test chart. The light-sensitive sheets thus light-exposed were laminated with the same image receiving element as used in Example 1. The same treatment solution as used in Example 1 was spread over between the two sheets. In such a manner, a number of samples having different thickness of the treatment solution were prepared.

These sheets were treated at a temperature of 25° C., and then peeled off the image receiving element 90 seconds thereafter.

Table 3 shows the maximum density. As can be seen in Table 3, the light-sensitive sheet 2, due to the presence of a void layer, shows a lowered treatment solution thickness dependence, which minimizes the effect of uneven thickness of the treatment solution caused by the roller or the like during spreading.

TABLE 3

| Light-Sensitive Sheet No. | Treatment Solution Thickness (μm) | Blue | Green | Red |
|---|---|---|---|---|
| 1 | 46 | 2.03 | 2.11 | 1.89 |
| | 53 | 2.06 | 2.42 | 2.37 |
| | 65 | 2.08 | 2.50 | 2.50 |
| 2 | 46 | 2.00 | 2.40 | 2.38 |
| | 53 | 2.02 | 2.53 | 2.45 |
| | 65 | 2.04 | 2.53 | 2.49 |

EXAMPLE 3

The light-sensitive sheets 1 and 2 as used in Example 1 were treated in the same manner as in Example 1 except in that the treatment temperature was changed.

The light-sensitive sheets treated at a temperature of 15° C. were peeled off the image receiving element 3 minutes after the treatment. The samples treated at a temperature of 25° C. were peeled off 90 seconds after the treatment, and the samples treated at a temperature of 35° C. were peeled off 60 seconds after the treatment. The results of this test are shown in Table 4.

As can be seen in Table 4, the light-sensitive sheet 2 showed less temperature dependence of the maximum density in comparison with light-sensitive sheet 1.

TABLE 4

| Light-sensitive Sheet No. | Temperature | Blue | Green | Red |
|---|---|---|---|---|
| 1 | 15° C. | 1.78 | 2.23 | 2.61 |
| | 25° C. | 2.08 | 2.50 | 2.50 |

TABLE 4-continued

| Light-sensitive Sheet No. | Temperature | Blue | Green | Red |
|---|---|---|---|---|
| | 35° C. | 2.17 | 2.58 | 1.89 |
| 2 | 15° C. | 1.80 | 2.21 | 2.53 |
| | 25° C. | 2.04 | 2.53 | 2.49 |
| | 35° C. | 2.15 | 2.59 | 2.18 |

EXAMPLE 4

A light-sensitive sheet was prepared in the same manner as used in the case of light-sensitive sheet 5 of Example 1, except in that the layer (2) further contained 0.09 $g/m^2$ of carbon black.

After being subjected to the same forced aging test as used in Example 2, the sample thus prepared was treated as described in Example 2. The value of red light-sensitivity was determined in terms of the value of log E corresponding to a density of 0.7.

As can be seen in Table 5, the light-sensitivity sheet 5 showed a change in the tint of the cyan dye-releasing redox compound layer over the forced aging test which caused a change in the light reflection by the void layer which impaired the sensitivity thereof, whereas the light-sensitive sheet 9, which had carbon black provided between the void layer and the emulsion layer, showed less change in the sensitivity thereof.

TABLE 5

| Light-sensitive Sheet No. | Fresh | Dry | Wet |
|---|---|---|---|
| 1 (same as that of Example 1) | −0.94 | −0.95 | — |
| 5 | −1.04 | −0.96 | −1.00 |
| 9 | −0.92 | −0.92 | −0.94 |

While the invention has been described in detail and with reference to specific embodiments thereof, it will be apparent to one skilled in the art that various changes and modifications can be made therein without departing from the spirit and scope thereof.

What is claimed is:

1. A multilayer color photographic light-sensitive material containing no image-receiving layer, which comprises a support, an internal latent image type direct reversal silver halide emulsion layer combined with a dye-providing substance, and a void layer between the support and the layer containing the dye-providing substance closest to the support.

2. A multilayer color photographic light-sensitive material as in claim 1, wherein the void layer comprises solid particles dispersed in a binder.

3. A multilayer color photographic light-sensitive material as in claim 2, wherein the binder is a hydrophilic binder.

4. A multilayer color photographic light-sensitive material as in claim 2, wherein the solid particles are selected from the group consisting of white lead, zinc oxide, titanium dioxide, barium sulfate, lithopone, zirconium oxide, aureolin, cobalt green, cobalt blue, cerulean blue, cobalt violet, ultramarine, cadmium red, lead chromate, indathrene blue, phthalocyanine blue, silica, carbon black, finely divided glass particles, diatomaceous earth, and particulate polymer.

5. A multilayer color photographic light-sensitive material as in claim 4, wherein said solid particles comprise titanium dioxide.

6. A multilayer color photographic light-sensitive material as in claim 2, wherein the solid particles are present in the void layer in an amount of from about 1 $g/m^2$ to 10 $g/m^2$.

7. A multilayer color photographic light-sensitive material as in claim 1, wherein the void volume is from 0.1 $cm^3/m^2$ to 2 $cm^3/m^2$.

8. A multilayer color photographic light-sensitive material as in claim 2, wherein the void volume is from 0.1 $cm^3/m^2$ to 2 $cm^3/m^2$.

9. A multilayer color photographic light-sensitive material as in claim 2, wherein the void volume is from 0.1 $cm^3/m^2$ to 2 $cm^3/m^2$.

10. A multilayer color photographic light-sensitive material as in claim 6, wherein the void volume is from 0.1 $cm^3/m^2$ to 2 $cm^3/m^2$.

11. A multilayer color photographic light-sensitive material as in claim 1, wherein the thickness of the void layer is from 1 μm to 10 μm.

12. A multilayer color photographic light-sensitive material as in claim 2, wherein the thickness of the void layer is from 1 μm to 10 μm.

13. A multilayer color photographic light-sensitive material as in claim 9, wherein the thickness of the void layer is from 1 μm to 10 μm.

14. A multilayer color photographic light-sensitive material as in claim 10, wherein the thickness of the void layer is from 1 μm to 10 μm.

15. A multilayer color photographic light-sensitive material as in claim 2, wherein the average particle diameter is from 0.1 μm to 10 μm.

16. A multilayer color photographic light-sensitive material as in claim 13, wherein the average particle diameter is from 0.1 μm to 10 μm.

17. A multilayer color photographic light-sensitive material as in claim 1, wherein the distance between the silver halide emulsion layer closest to the support and the void layer is 10 μm or less.

18. A multilayer color photographic light-sensitive material as in claim 2, wherein the distance between the silver halide emulsion layer closest to the support and the void layer is 10 μm or less.

19. A multilayer color photographic light-sensitive material as in claim 1, wherein a dye-providing substance layer combined with the silver halide emulsion layer closest to the support is interposed between the void layer and the silver halide emulsion layer.

20. A multilayer color photographic light-sensitive material as in claim 2, wherein a dye-providing substance layer combined with the silver halide emulsion layer closest to the support is interposed between the void layer and the silver halide emulsion layer.

* * * * *